US007614858B2

(12) United States Patent
Tanasuca

(10) Patent No.: US 7,614,858 B2
(45) Date of Patent: Nov. 10, 2009

(54) VARIABLE CAPACITY VANE PUMP WITH FORCE REDUCING CHAMBER ON DISPLACEMENT RING

(75) Inventor: Cezar Tanasuca, Richmond Hill (CA)

(73) Assignee: Magna Powertrain Inc., Concord, Ontario (CA)

( * ) Notice: Subject to any disclaimer, the term of this patent is extended or adjusted under 35 U.S.C. 154(b) by 381 days.

(21) Appl. No.: 11/577,755

(22) PCT Filed: Oct. 25, 2005

(86) PCT No.: PCT/CA2005/001640

§ 371 (c)(1),
(2), (4) Date: Apr. 23, 2007

(87) PCT Pub. No.: WO2006/045190

PCT Pub. Date: May 4, 2006

(65) Prior Publication Data

US 2009/0074598 A1 Mar. 19, 2009

(51) Int. Cl.
*F04C 2/344* (2006.01)

(52) U.S. Cl. ..... 418/26; 418/24; 418/25; 418/27; 418/30

(58) Field of Classification Search ..... 418/24–27, 418/30

See application file for complete search history.

(56) References Cited

U.S. PATENT DOCUMENTS 3,451,344 A * 6/1969 Trick ..... 418/27
4,531,893 A * 7/1985 Okoh et al. ..... 418/26
4,538,974 A * 9/1985 Stich et al. ..... 418/26
4,711,616 A 12/1987 Tsukahara et al.
5,090,881 A 2/1992 Susuki et al.
5,690,479 A 11/1997 Lehmann et al.
5,752,815 A 5/1998 Muller
5,895,209 A * 4/1999 Miyazawa ..... 418/26
6,375,435 B2 4/2002 Sundberg et al.
6,457,946 B2 10/2002 Gretzshel et al.
6,763,797 B1 7/2004 Staley et al.
6,786,702 B2 9/2004 Zagranski et al.
6,790,013 B2 9/2004 Hunter et al.

FOREIGN PATENT DOCUMENTS

JP 03271581 A * 12/1991
JP 03279686 A * 12/1991

* cited by examiner

*Primary Examiner*—Thomas E Denion
*Assistant Examiner*—Mary A Davis

(57) ABSTRACT

A novel variable displacement vane pump is provided wherein pressurized working fluid is provided to a portion of the pump chamber to act on the outside of the capacity varying ring to substantially balance the force created by the high pressure working fluid inside the ring. As the resultant high pressure force acting on the pivoting pin is reduced, the movement of the displacement control ring is smoother, reducing undesirable hysteresis, the wear on the pin is reduced and the additional force required to move the ring to vary the volumetric displacement of the pump is less than would otherwise be needed, allowing the related control mechanisms to be smaller.

12 Claims, 5 Drawing Sheets

VARIABLE CAPACITY VANE PUMP WITH FORCE REDUCING CHAMBER ON DISPLACEMENT RING

FIELD OF THE INVENTION

The present invention relates to a variable capacity vane pump. More specifically, the present invention relates to a variable capacity vane pump wherein the imbalance in forces on the displacement ring is reduced to allow improved control of the ring.

BACKGROUND OF THE INVENTION

Variable capacity vane pumps are well known and feature a capacity adjusting element in the form of a pump displacement ring, or slide, that can be moved to alter the eccentricity of the pump and hence alter the volumetric capacity of the pump. Typically, the ring is mounted within the pump body by a pivot pin and an appropriate control system, often a piston or pressurized chamber acting against a spring, is provided to move the ring about the pivot to obtain the desired equilibrium pressure from the pump.

While such pumps operate well, they do suffer from disadvantages in that the control system components tend to be relatively large as they must counter the imbalance of forces acting on the ring when moving the ring to alter the volumetric capacity of the pump. Specifically, the pressurized working fluid produced by the pump acts against the ring to force the ring in one direction. In order to act against this force, the control system for the ring typically must have larger components than would otherwise be necessary to move the ring. In many circumstances, especially in an automotive engine environment, these larger components require space which may not be available, or which could be put to better use.

SUMMARY OF THE INVENTION

It is an object of the present invention to provide a novel variable capacity vane pump which obviates or mitigates at least one disadvantage of the prior art.

According to a first aspect of the present invention, there is provided a variable displacement vane pump comprising: a pump rotor having a plurality of moveable vanes; a pump housing defining a pump chamber with the rotor being located within the chamber; a displacement varying ring pivotally mounted in the pump chamber, the displacement varying ring enclosing the pump rotor to define a high pressure area and a low pressure area about the rotor, the pump housing having an inlet to admit working fluid into the low pressure area and an outlet to receive higher pressure working fluid from the high pressure area; a control mechanism to pivot the displacement varying ring within the pump chamber to vary the volumetric displacement of the pump; and wherein the outlet also provides working fluid to a first portion within the pump chamber outside the displacement varying ring, the working fluid in the first portion acting on an area substantially similar to the area inside the displacement varying ring acted upon by the working fluid in the high pressure area of the pump to reduce the net force exerted on the displacement varying ring by the high pressure working fluid.

The present invention provides a novel variable displacement vane pump wherein high pressure working fluid is provided to a portion of the pump chamber to act on the outside of the displacement control ring to substantially balance the force created by the high pressure working fluid inside the ring. Similarly, low pressure working fluid acts on a portion of the displacement control ring from both inside and outside the pump chamber to substantially balance the forces created these pressures on the displacement control ring. As the resultant pressure forces acting on the pivoting pin are reduced, the movement of the displacement control ring can be smoother, reducing undesirable hysteresis, the wear on the pivot pin is reduced and the additional force required to move the displacement control ring to vary the volumetric displacement of the pump is less than would otherwise be needed, allowing the related control mechanisms to be smaller.

BRIEF DESCRIPTION OF THE DRAWINGS

Preferred embodiments of the present invention will now be described, by way of example only, with reference to the attached Figures, wherein.

DETAILED DESCRIPTION OF THE INVENTION

Figure 1:
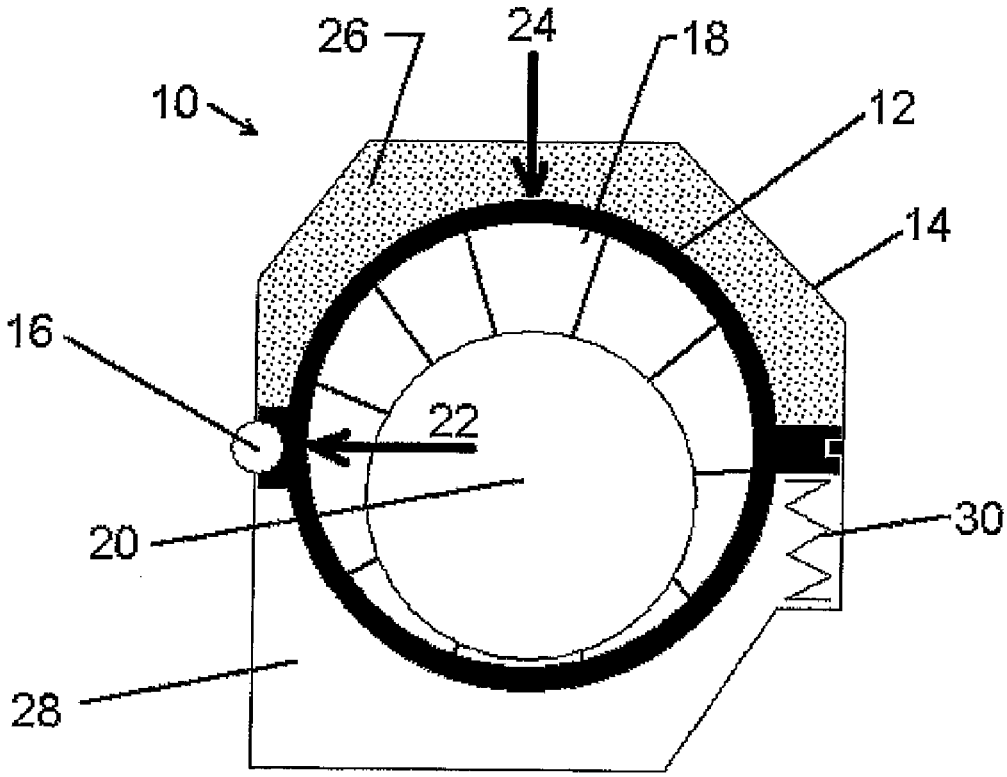
Fig.1 (prior art)
FIG. 1 shows a schematic representation of a prior art variable displacement vane pump.

A prior art variable capacity vane pump is indicated at 10 in FIG. 1. As shown, pump 10 includes a displacement ring 12 which is mounted with the body 14 of pump 10 via a pivot pin 16. Ring 12 defines a pump chamber 18 within which the pump rotor 20 is located.

In the illustrated pump 10, the left hand side of pump chamber 18 is the high pressure side of pump 10 and the right hand side is the low pressure side. As will be apparent, the resultant pressure differential acting on the inside of the ring 12 results in a net force, indicated by arrow 22, being produced on pivot pin 16. Depending upon the operating pressure of pump 10 and the size of ring 12, force 22 can exert significant force on pin 16.

In addition to force 22, a second net force, indicated by arrow 24, acts on the outside of the ring 12 from the pressurized working fluid in area 26. Second force 24 moves ring 12 to act against spring 30, which is part of the capacity control mechanism of pump 10.

As will be apparent, force 24 results in a requirement that control spring 30 be larger than would other wise be the case. Further, as force 24 rotates ring 12 about pivot pin 16, force 22 will rotate with ring 12 and will act in different directions on pin 16 which can, in some circumstance, result in undesirable hysteresis, or "hunting", of pump 10 about its equilibrium point. Finally, pivot pin 12 must be sized to accommodate forces 22 and 24 and can wear at a faster rate due to these forces.

Figure 2:
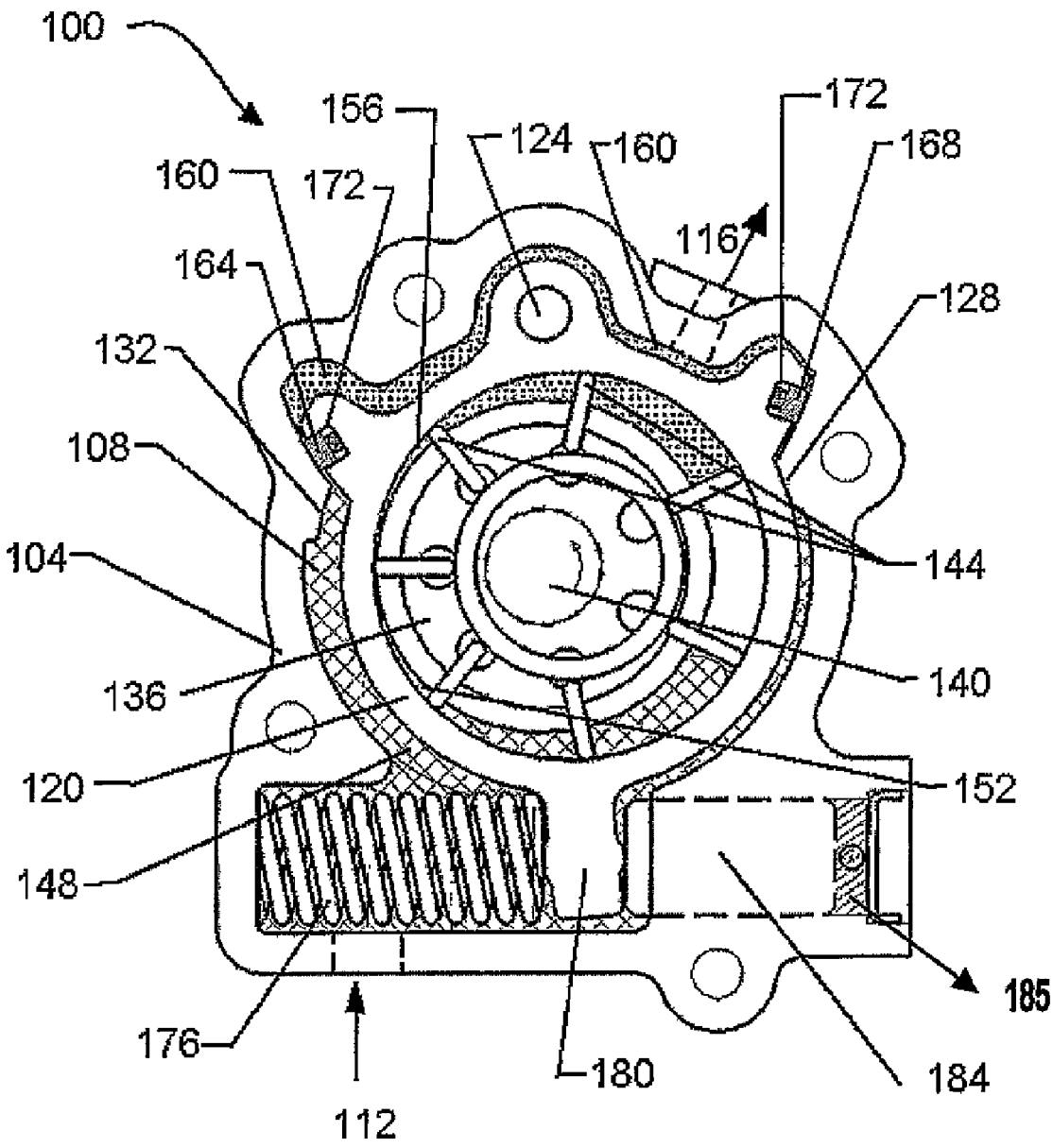
FIG. 2 shows a front view of a first embodiment of a variable capacity vane pump in accordance with the present invention with a displacement varying ring in a maximum displacement position.

FIG. 2 shows an embodiment of a pump 100 in accordance with the present invention. Pump 100 includes a housing 104 defining a pump chamber 108 there within. Chamber 108 has a working fluid inlet 112 on the back side of housing 104, through which working fluid is admitted to chamber 108, and a working fluid outlet 116 on the back side of housing 104 through which pressurized working fluid exits chamber 108.

A displacement varying ring 120 is mounted in chamber 108 via a pivot pin 124 and ring 120 can pivot within a range defined between positions wherein ring 120 abuts against full displacement stop 128 or minimum displacement stop 132.

Chamber 108 further includes a pump rotor 136, which turns with pump drive shaft 140, and rotor 136 includes the pump vanes 144 which rotate with rotor 136.

As illustrated, inlet port 112 admits inlet working fluid to a portion 148 of the interior of pump chamber 108, from where it is drawn into the low pressure side 152 of the interior of ring 120. Similarly, the high pressure side 156 of the interior of ring 120 is connected to a portion 160 of the interior of pump chamber 108 and then to outlet 116. Portion 148 and portion 160 of pump chamber 108 are separated by a pair of seals 164 and 168 which act between housing 104 and slots 172 in ring 120 to seal low pressure portion 148 from high pressure portion 160. Seals 164 can be fabricated from any suitable material such as elastomeric rubber compounds, etc.

The area of ring 120 on which working fluid in portion 160 acts is designed to be similar to the area of ring 120 on which working fluid in high pressure side 156 acts. Similarly, the area of ring 120 on which working fluid in portion 148 acts is designed to be similar to the area of ring 120 on which working fluid in low pressure side 152 acts. Thus, as will now be apparent, the net forces on ring 120 generated by the working fluid in pump 100 are reduced. If the sizes of areas of portion 160 and portion 148 are carefully selected, the net forces exerted by the working fluid can be substantially reduced, or even balanced.

As will be apparent, the undesired force resulting from the high pressure working fluid in portion 160 is typically far greater than the undesired force resulting from the low pressure working fluid in portion 148. Thus, while it is preferred that both undesired forces be reduced, the reduction of the forces produced in portion 160 is the priority and much of the advantage of the present invention can be achieved without reducing the forces produced in portion 148.

Control of the equilibrium pressure of pump 100 is achieved, in a largely conventional manner, by a control spring 176 which biases a control tab 180 on ring 120 towards a control piston 184. Control piston 184 has control volume 185 that communicates with a supply of pressurized working fluid from outlet 116, or other suitable supply, applied to it to create a force on control piston 184 to move ring 120. However, as will now be apparent, both control spring 176 and control piston 184 are smaller than would otherwise be required due to the reduction of the net forces between portion 160 and side 156 and between portion 148 and side 152. Further, the forces exerted on pivot pin 124 are reduced.

Figure 3:
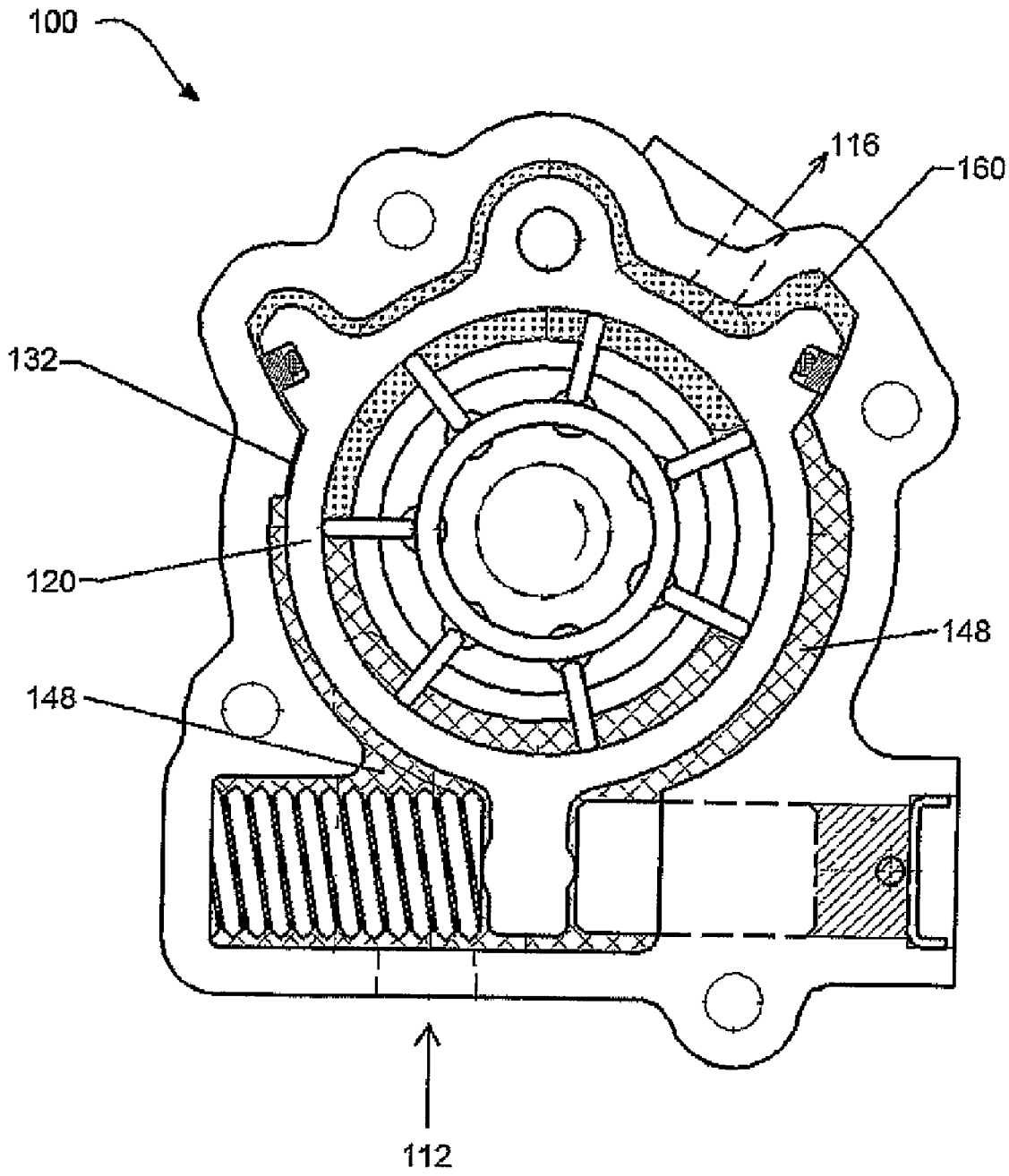
FIG. 3 shows the pump of FIG. 2 with the displacement varying ring in a minimum displacement position.

FIG. 2 shows pump 100 with ring 120 in its maximum displacement position, with ring 120 abutting stop 128. In contrast, FIG. 3 shows pump 100 in its minimum displacement position with ring 120 abutting stop 132.

Figure 4:
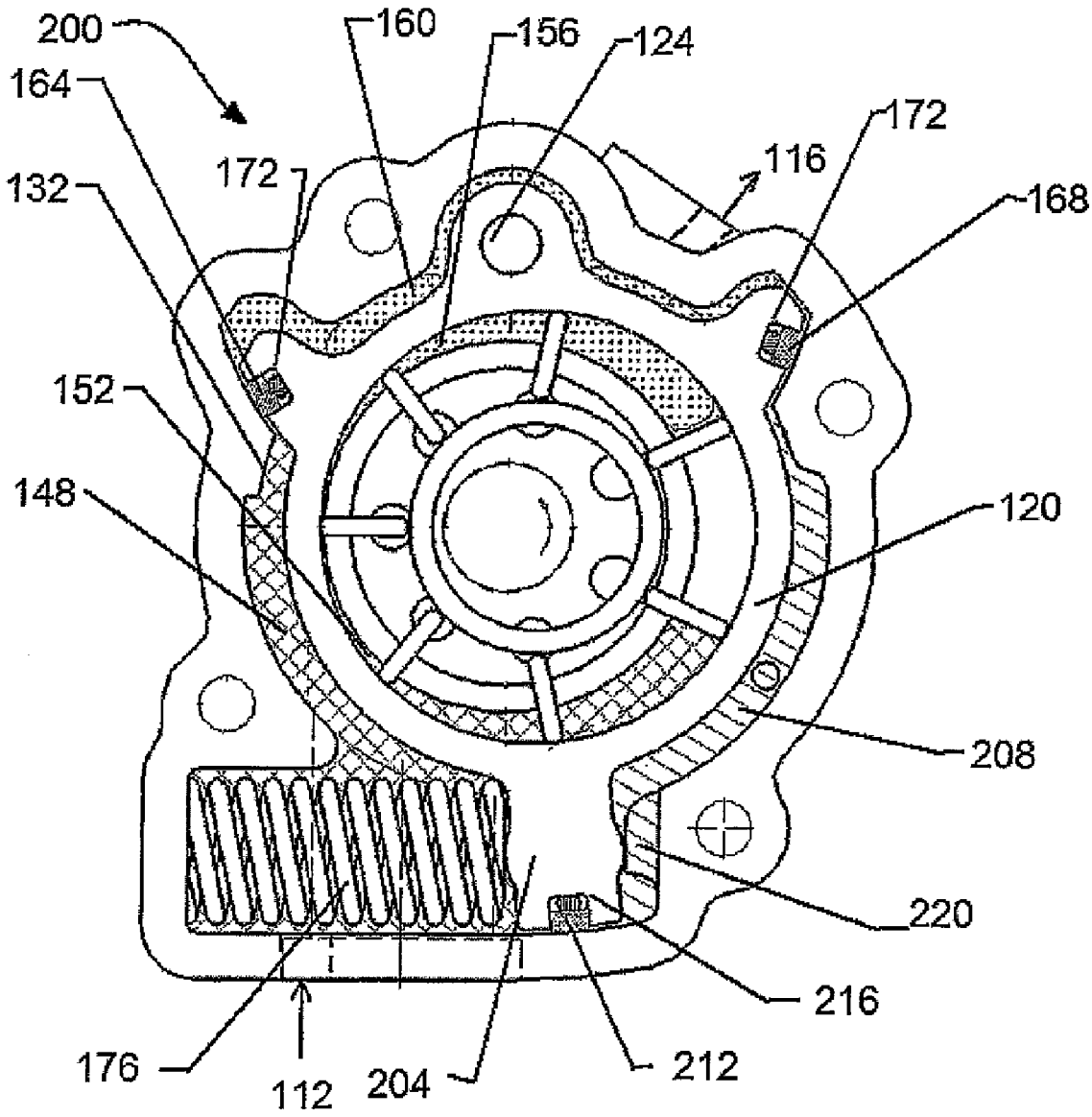
FIG. 4 shows a front view of a second embodiment of a variable capacity vane pump in accordance with the present invention with a displacement varying ring in a maximum displacement position.

FIG. 4 shows a second embodiment of a variable displacement vane pump 200 in accordance with the present invention. In the Figure, like components to those shown in FIGS. 2 and 3 are indicated with like reference numerals. In this embodiment, control of the equilibrium pressure is performed with control spring 176 which acts against a control tab 204 in a manner similar to that described above in the previous embodiment. However, unlike pump 100 described above, with pump 200, the control force which acts against control spring 176 results from the pressurize working fluid supplied to control area 208 which acts upon ring 120, in a similar manner to that disclosed in prior art U.S. Pat. No. 4,342,545. The forces resulting from working fluid pressure in portion 148 are still largely balanced by the forces created in pump side 152, as are the forces resulting from working fluid pressure in portion 160 which are largely balanced by the forces created in pump side 156.

As can be seen, an additional seal 212 is located in a slot 216 at the end of control tab 204 to isolate working fluid in control area 208 from working fluid in portion 148. As before, seal 212 can be fabricated in any suitable manner of any suitable material.

As is also illustrated, control tab 204 abuts a maximum displacement stop 220 which limits movement of ring 120 in the displacement increasing direction.

Figure 5:
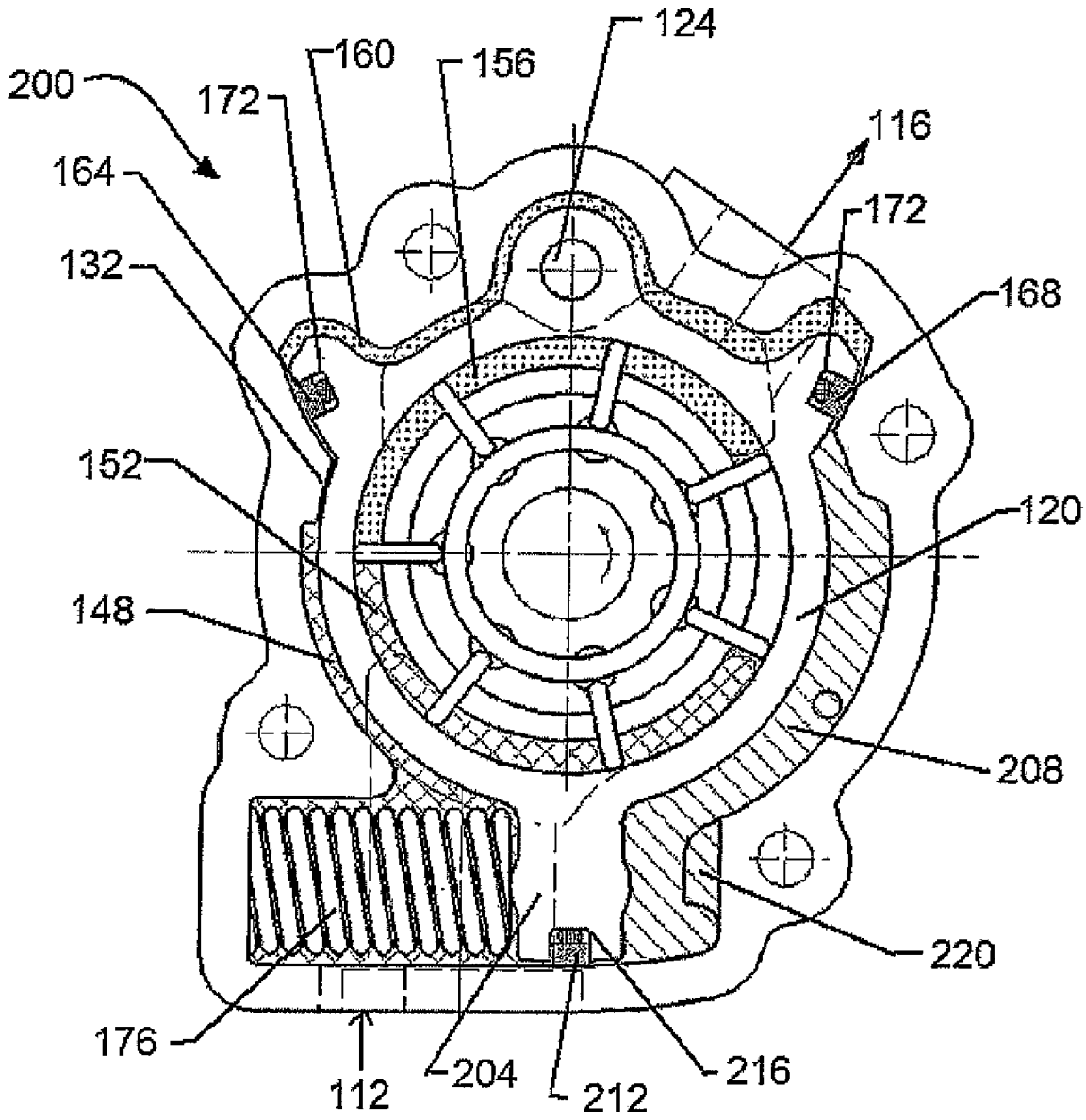
FIG. 5 shows the pump of FIG. 4 with the displacement varying ring in a minimum displacement position.

FIG. 5 shows pump 200 with ring 120 in the minimum displacement position wherein ring 120 abuts minimum displacement stop 132.

Control of the equilibrium pressure of pump 200 is achieved, in a similar manner to that of pump 100. Control spring 176 biases control tab 204 on ring 120 towards control area 208. Control area 208 is supplied with pressurized working fluid from outlet 116, or other suitable supply, to create a force on ring 120 against the force of control spring 176. However, as will now be apparent, both control spring 176 and the area of control area 208 are smaller than would otherwise be required due to the net reduction in the forces between portion 160 and side 156 and between portion 148 and side 152. Further, the forces exerted on pivot pin 124 are reduced.

The present invention provides a novel variable displacement vane pump wherein the working fluid in portion 148 of pump chamber 108 acts on the outside of ring 120 to reduce the net forces created by the working fluid in low pressure area 152 acting on the inside of ring 120. Similarly, the working fluid in portion 160 of pump chamber 108 acts on the outside of ring 120 to reduce the net forces created by the working fluid in high pressure area 156 acting on the inside of ring 120. As these forces are reduced, and especially the force created by the high pressure working fluid in portion 160, the force required to move ring 120 to vary the volumetric displacement of the pump is less than would otherwise be required, allowing the related control mechanisms to be smaller and reducing the forces which were applied to pivot pin 124.

As will be apparent to those of skill in the art, the present invention is not limited to use with variable displacement vane pumps utilizing control springs and control pistons, or control springs and pressurized control areas to control the pump and it is instead contemplated that the present invention can be advantageously employed with variable displacement vane pumps utilizing a wide variety of control mechanisms.

The above-described embodiments of the invention are intended to be examples of the present invention and alterations and modifications may be effected thereto, by those of skill in the art, without departing from the scope of the invention which is defined solely by the claims appended hereto.

I claim:

1. A variable displacement vane pump comprising:

a pump rotor having a plurality of moveable vanes;

a pump housing defining a pump chamber with the rotor being located within the chamber;

a displacement varying ring pivotally mounted in the pump chamber, the ring enclosing the pump rotor to define a high pressure area and a low pressure area about the rotor, the pump housing having an inlet to admit working fluid into the low pressure area and an outlet to deliver pressurized working fluid from the high pressure area;

a control mechanism pivoting the ring within the pump chamber to vary the volumetric displacement of the pump in response to outlet pressure of said working fluid; and wherein the outlet also provides working fluid to a first portion within the pump chamber outside the ring, the working fluid in the first portion acting on an area substantially similar to the area inside the ring acted upon by the working fluid in the high pressure area of the pump to reduce the net force exerted on the ring by the high pressure working fluid.

2. The variable displacement pump of claim 1 wherein the inlet also provides working fluid to a second portion within the pump chamber outside the ring, the working fluid in the second portion acting on an area substantially similar to the area inside the ring acted upon by the working fluid in the low pressure area of the pump to reduce the net force exerted on the ring by the low pressure working fluid.

3. The variable displacement vane pump of claim 2 wherein the control mechanism comprises a control spring biasing the ring to a maximum displacement position, and a control piston, supplied with pressurized working fluid, which acts against the control spring to bias the ring to a minimum displacement position.

4. The variable displacement vane pump of claim 1 wherein the control mechanism comprises a control spring biasing the ring to a maximum displacement position, and a control piston, supplied with pressurized working fluid, which acts against the control spring to bias the ring to a minimum displacement position.

5. The variable displacement vane pump of claim 1 wherein the control mechanism comprises a control spring biasing the ring to a maximum displacement position, and a control volume between the pump housing and the ring, the control volume being supplied with pressurized working fluid which urges the ring against the control spring to bias the ring towards a minimum displacement position.

6. The variable displacement vane pump of claim 1 wherein said housing has full displacement stop and a minimum displacement stop, said stops limiting travel of said ring between a minimum displacement position and a maximum displacement position.

7. The variable displacement vane pump of claim 6 further comprising seals extending between said ring and said housing defining said first portion.

8. The variable displacement pump of claim 7 wherein said seals define a second portion within the pump chamber outside the ring, said second portion communicating with said low pressure area, the working fluid in the second portion acting on an area of said ring substantially similar to the area inside the ring acted upon by the working fluid in the low pressure area of the pump to reduce the net force exerted on the ring by the low pressure working fluid.

9. The variable displacement vane pump of claim 8 wherein the control mechanism comprises a control spring biasing the ring to a maximum displacement position, and a control piston, supplied with pressurized working fluid, which acts against the control spring to bias the ring to a minimum displacement position.

10. The variable displacement vane pump of claim 9 wherein said seals are mounted on said ring and slidably engage said housing.

11. The variable displacement vane pump of claim 8 further comprising a third seal between the ring and said housing, said third seal defining a control volume, and the control mechanism comprises a control spring biasing the ring to a maximum displacement position, the control volume being supplied with pressurized working fluid which urges the ring against the control spring to bias the ring towards a minimum displacement position.

12. The variable displacement vane pump of claim 11 wherein said seals are mounted on said ring and slidably engage said housing.

* * * * *